US005551646A

United States Patent [19]

Goldstein

[11] Patent Number: 5,551,646

[45] Date of Patent: Sep. 3, 1996

[54] RIBBON CURLING AND RIBBON SPLITTING DEVICE

[76] Inventor: Fredric Goldstein, Värmdövägen 207, 13141 Nacka, Sweden

[21] Appl. No.: 211,026

[22] PCT Filed: Sep. 16, 1992

[86] PCT No.: PCT/EP92/02138

§ 371 Date: May 13, 1994

§ 102(e) Date: May 13, 1994

[87] PCT Pub. No.: WO93/05932

PCT Pub. Date: Apr. 1, 1993

[30] Foreign Application Priority Data

| | | | |
|---|---|---|---|
| Sep. 17, 1991 | [GB] | United Kingdom | 9119782 |
| Sep. 27, 1991 | [GB] | United Kingdom | 9120570 |
| Jul. 10, 1992 | [GB] | United Kingdom | 9214747 |

[51] Int. Cl.[6] ..... B26B 27/00; B65H 35/00; B65H 35/02

[52] U.S. Cl. ..... 242/419; 242/566; 242/588.2; 242/601; 225/56

[58] Field of Search ..... 242/419, 422.5, 242/566, 588, 588.1, 588.2, 601; 225/56, 65; 30/304

[56] References Cited

U.S. PATENT DOCUMENTS

| | | |
|---|---|---|
| 2,588,043 | 3/1952 | Rabinowitz et al. . |
| 2,703,208 | 3/1955 | Tasker . |
| 3,378,184 | 4/1968 | Mallory . |

FOREIGN PATENT DOCUMENTS

| | | |
|---|---|---|
| 4021735 | 4/1991 | European Pat. Off. . |
| 0443859 | 8/1991 | European Pat. Off. . |
| 9116178 | 10/1991 | European Pat. Off. . |
| 738142 | 12/1953 | United Kingdom . |
| 791642 | 3/1956 | United Kingdom . |
| 1262688 | 2/1972 | United Kingdom . |
| 2221871 | 2/1990 | United Kingdom . |

*Primary Examiner*—Daniel P. Stodola
*Assistant Examiner*—William A. Rivera
*Attorney, Agent, or Firm*—Stroock & Stroock & Lavan

[57] ABSTRACT

A ribbon curling device (13,110) for attachment to a spool (11,116) of gift wrapping ribbon is engageable on or around the spool such that the spool may rotate relative to the device in use. The device defines a ribbon exit pathway for guiding the ribbon to a curling edge (19,47,115) whereby a length of ribbon drawn from the spool may be curled.

32 Claims, 3 Drawing Sheets

RIBBON CURLING AND RIBBON SPLITTING DEVICE

This invention relates to a ribbon curling and/or ribbon splitting device, particularly for curling and/or splitting gift ribbon. Such a device is disclosed in GBA-2221871. Gift wrapping ribbon, usually of polypropylene, is relatively cheap and strong. It has the property of curling when the fibres thereof are subjected to stress on one side of the ribbon.

This invention is concerned with a ribbon curling and/or splitting device for direct use with a conventional spool or reel of ribbon.

U.S. Pat. No. 2703208 discloses a drum like device for receiving a roll of curlable cellulosic tape; the device includes a slot for tape exit and a curling edge against which ribbon is curled by the direct application of thumb pressure.

According to one aspect the present invention comprises a ribbon curling device for use with a spool or reel of gift wrapping ribbon, the device being engageable on or around the spool such that the spool may rotate in use relative to the device, and the device defining a ribbon exit pathway generally radially of the spool and a ribbon curling edge whereby a length of ribbon may be curled on being drawn from said spool, characterized in that said pathway defines ribbon guide means to ensure a substantially constant approach angle of ribbon to said edge, and said device further includes means for exerting in use a drag force on the ribbon or on the spool.

According to another aspect the present invent ion comprises a ribbon splitting device for use with a reel or spool of gift wrapping ribbon, the device being engageable on or around the spool such that the spool may rotate in use relative to the device, and the device having a ribbon exit opening generally radially of the spool, said opening defining ribbon splitting means whereby a length of ribbon may be split on being drawn from said spool.

Preferably the device incorporates both a ribbon curling edge and ribbon splitting means.

In a preferred embodiment the device comprises a flexible split band having radially outwardly extending end portions, one of said portions having a radially outward curling edge extending substantially parallel to the axis of rotation of said band, in use said band substantially encircling a cylindrical spool of ribbon and said end portions defining said exit aperture.

Preferably said band is a close fit about a spool; different band sizes may be provided for different spool diameters.

In one embodiment said end portions may include a circumferentially extending abutment to space said portions by a predetermined amount, in use the foot of one of said portions determining the approach angle of ribbon to said curling edge. Preferably axially spaced abutments are provided to define a ribbon exit gate bounded on all sides.

In another embodiment the end portions are adapted to abut one another, in use squeezing a ribbon therebetween.

The split band may be transparent to enable a user to see the ribbon.

The split band may include latching means to disengageably engage the free ends of said band about a cylindrical spool.

The split band may be sized to circumferentially engage a spool and thereby apply in use a force to retard relative rotation thereof. The band may be radially squeezable.

The device may incorporate ribbon splitting means comprising splitting hooks for splitting ribbon into several strands, said hooks facing from one of said end portions towards the other.

Preferably said hooks extend from the end portion having said curling edge. The hooks may engage in apertures formed in the other end portion.

In another preferred embodiment said split band may engage circumferential slots provided on the inwardly facing side edges of a spool rim. Alternatively said end portions may have radially inwardly extending arms at either side thereof, said arms meeting at the radially inner end and have mutually facing projections for engagement in the centre aperture of a spool. Preferably the arms are flexible though they may be journalled on one another for relative circumferential movement.

Whilst the band is preferably substantially circular so that it may be retained in a spool by its own resilience, it may be substantially flat and wrapped around a spool in use.

In another embodiment the curling device may comprise arcuate curling and abutment members for location on guide means of a ribbon spool, the curling and abutment members having radially outwardly extending end portions, one of said portions having a curling blade extending in use substantially parallel to the rotational axis of said spool.

In a preferred embodiment the guide means may comprise opposite arcuate grooves in the flanges of said spool; the flanges may face each other.

According to another aspect of the invention, the device includes a curling edge, ribbon guide means, and means for attaching said device to a ribbon spool such that in use the guide means and curling edge overlie ribbon on said spool.

The device may include a pressure pad for exerting a drag force on the ribbon or on the spool.

In a preferred embodiment the device provides means by which the spool is supported for rotation, in use the device being gripped between thumb and forefinger.

The device may include splitting hooks and a cutting blade.

According to another embodiment of the invention, the device includes a plurality of splitting hooks, ribbon guide means, and means for attaching said device to a ribbon spool such that in use the guide means and curling edge overlie ribbon on said spool.

Other aspects of the invention will be apparent from the following description of preferred embodiments in which:

FIG. 1 illustrates a conventional spool 11 on which a supply of ribbon 12 is wound.

Figure 1:
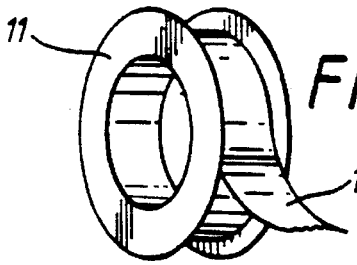
FIG. 1 illustrates a conventional ribbon spool.
Figure 2:
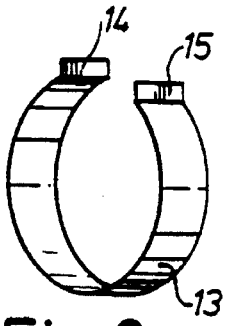
FIG. 2 illustrates a device according to a first embodiment of the invention.
Figure 4:
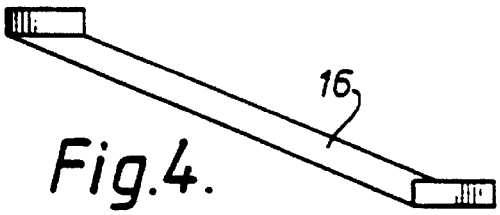
FIG. 4 illustrates the device of FIG. 2 in flat form.

FIG. 2 illustrates a device according to the invention and comprising a substantially circular band 13 having generally radially outwardly extending or upstanding end portions 14,15 at the ends thereof. The band may be made of any suitable flexible plastic or metal and may be flat strip 16 prior to use as illustrated in FIG. 4.

Figure 3:
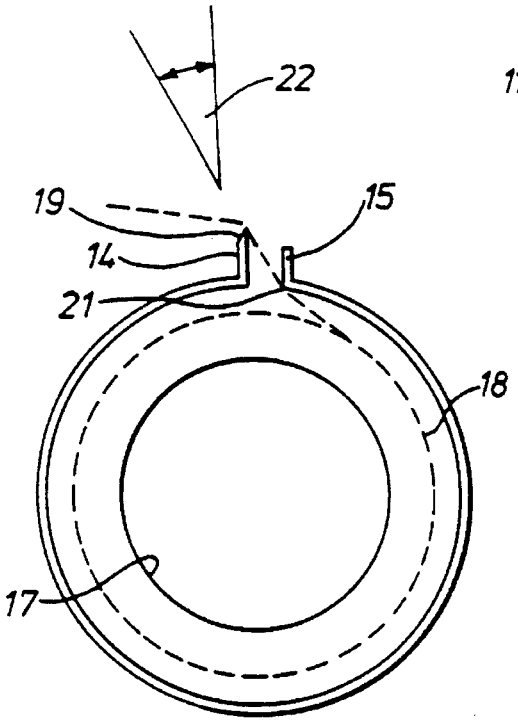
FIG. 3 illustrates schematically the device of FIG. 2 in use with the spool of FIG. 1.

The band 13 is further described with reference to FIG. 3 which illustrates a spool centre aperture 17 and the outer diameter 18 of a supply of ribbon. One end portion 14 of the band 13 defines a curling blade 19 extending approximately parallel to the axis of the spool; such curling blades are well known in the art. The base of the other end portion 15 defines a guide at its radially inner edge 21 which ensures a consistent ribbon approach angle 22 as the spool supply is used up. The inner corner of the portion 15 is radiused sufficiently to ensure that curling stress is not imposed on the ribbon.

The end portions 14,15 may be pressed against one another to obtain a desired curling effect.

Uncurled ribbon may be drawn from the spool by simply avoiding the curling blade 19 and/or not squeezing the band so that abutments 14 and 15 are in contact.

Figure 5:
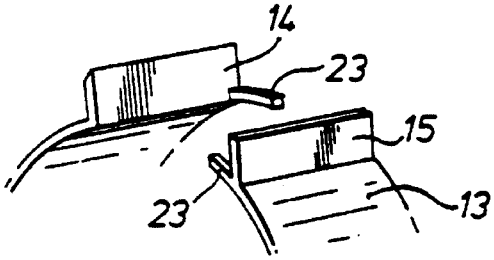
FIG. 5 illustrates end portions of the first embodiment having mutually facing abutments.

In order to ensure a consistent approach angle of the ribbon to the blade, the end portions may be separated by integral circumferentially extending abutments 23, as illustrated in FIG. 5, which together define a gate bounded on all sides and through which the ribbon exits in use. The abutments may be of any convenient shape and provided on one, the other or both end portions. The abutments are illustrated somewhat larger than necessary and would in practice be 1 mm or less; the ribbon exit gate need be sufficiently wide to ensure only that the ribbon has free passage.

The band 13 may include latching means to disengageably retain the band about the spool. Where the band is of plastic, the latching means may for example comprise conventional integral spring hooks and recesses.

Figure 6:
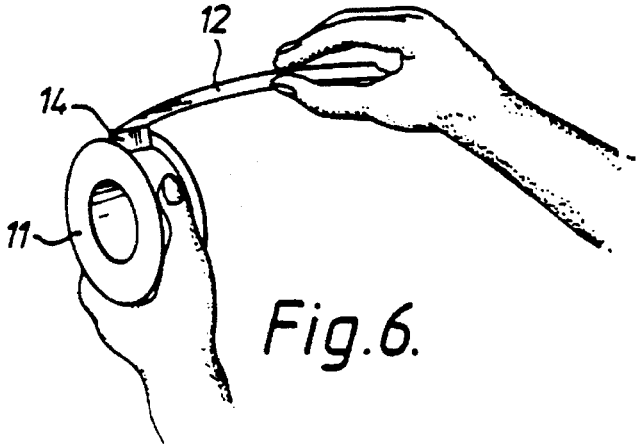
FIG. 6 illustrates the first embodiment of the invention in use

The necessary drag force between ribbon and curling edge may be provided in several ways. The flexible band may be radially deformed so that the user squeezes the ribbon supply between opposite sides of the band, as illustrated in FIG. 6. The band may alternatively frictionally engage the side walls of the spool, either by squeezing pressure applied by the user, or by the clamping force exerted by the latching means described above. In its normal state the band may rest inside radially the walls of the spool which act to prevent the band sliding off the spool laterally. The maximum diameter of ribbon on the spool may be less than the minimum diameter of the band to avoid variations in drag force on the ribbon as the ribbon diameter reduces in use.

Figure 7:
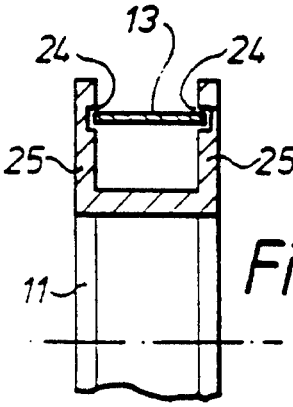
FIG. 7 is a partial axial section through a spool having a groove to receive a band according to the first embodiment.

The band 13 may be located in opposite slots 24 in the spool rims 25 as illustrates in FIG. 7, and the necessary drag force imposed by choosing appropriate slot dimensions. The drag force may be exerted or increased by axial pressure applied to the opposite sides 25 of the spool.

Figure 8:
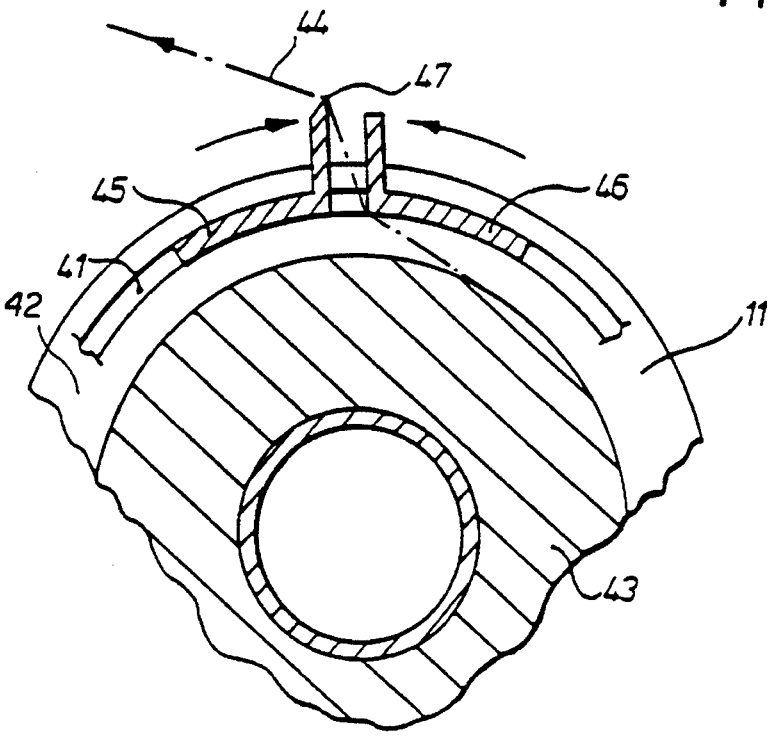
FIG. 8 is a sect ion through a diameter of a spool incorporating a second embodiment of the invention.

In another embodiment the ribbon curling device may comprise end portions of the band 13 and substantially as illustrated in FIG. 5. The end portions may be guided in opposite slots of the spool flange. FIG. 8 shows a spool 11 having an arcuate track 41 on the internal face of one flange 42—a similar track is provided on the facing flange. The ribbon supply is illustrated by reference 43 and the ribbon exit path by reference 44.

Slidable in the track 41 are two 'L' shaped members 45,46 which correspond to the end portions of band 13; one member 45 carries a curling edge 47. The ribbon may be curled by squeezing the members 45,46 toward one another between finger and thumb; the spool is supported by the members 45,46 and the user may use his free hand to draw out the ribbon. The arcuate track 41 may be circular.

Figure 9:
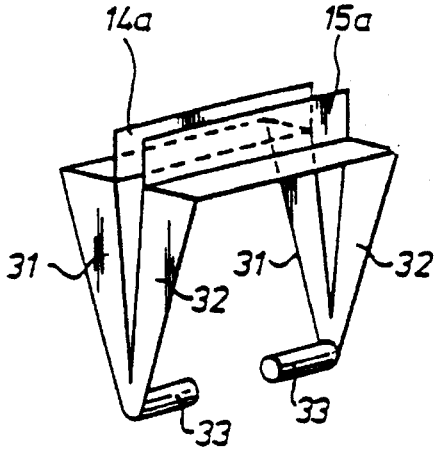
FIG. 9 illustrates a third embodiment of the invention.
Figure 10:
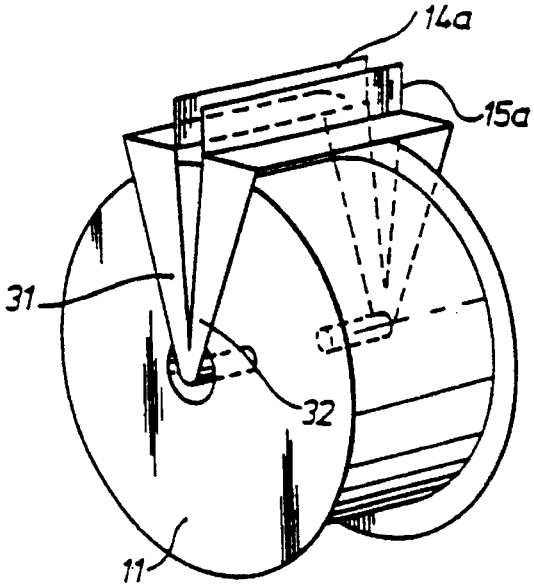
FIG. 10 illustrates the embodiment of FIG. 9 attached to a ribbon spool.

FIG. 9 illustrates an alternative embodiment in which the upstanding end portions **14*a*, 15*a*, are formed at the end of radially extending pairs of arms 31,32. The inner ends of arms 31 and 32 carry extensions 33 which extend towards one another and are dimensioned to fit the centre aperture of a ribbon spool. This embodiment is intended to be of flexible plastic and capable of being snapped over opposed rims of a spool as illustrated in FIG. 10. The arms 31,32 are sufficiently resilient to permit the end portions 14*a*,15*a* to be squeezed towards each other to effect ribbon curling. Drag force may be exerted by the axially inwards gripping force of the arms, or by a radial force exerted between the inner extensions 33 and the undersides of the end portions 14*a*, 15*a*. This embodiment may also include the features of opposed abutments to define a constant ribbon approach angle, and ribbon shredding teeth. Uncurled ribbon may be drawn off by avoiding the curling blade on end portion 14*a***.

Figure 11:
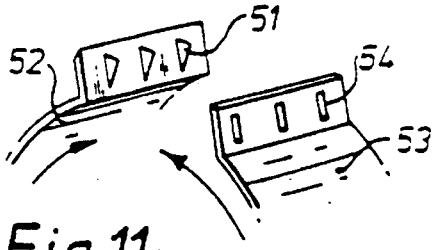
FIG. 11 illustrates shredding teeth for incorporation into the device of the first, second and third embodiments.

FIG. 11 illustrates teeth 51 on the end portions 52,53 of a curling device and suitable for incorporation with any of the embodiments described above. The teeth 51 engage in respective slots 54 of the facing end portion, ribbon between the end portions being pierced and shredded as the ribbon is drawn of the spool. Piercing and shredding may take place instead of or in addition to curling.

With reference to FIGS. 12–15, the device 110 comprises an arcuate base 111 having an upstanding leg 112 at one side, and a transverse arm 113 perpendicular to the leg 112 and generally overlying the base 111 as illustrated. A thumb pad 114 extends from the upstanding leg 112 and also overlies the base 111; a blade 115 extends upwardly from the upstanding leg 112 with the blade edge uppermost.

As will be described below, the thumb pad 114 and base 111 may in use be squeezed together, and in that case the device is advantageously manufactured as a one piece plastics moulding.

Figure 13:
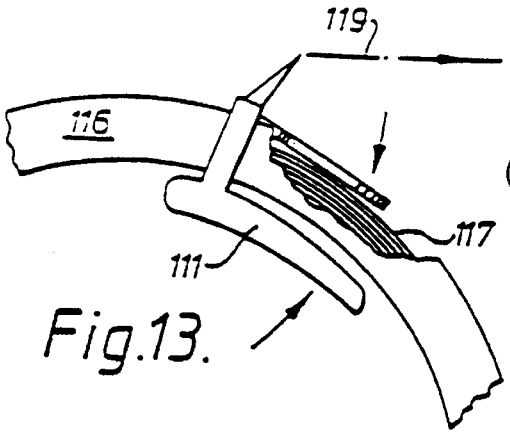
FIG. 13 is a partial elevation, cut away, of the device of FIG. 12 on a spool.
Figure 12:
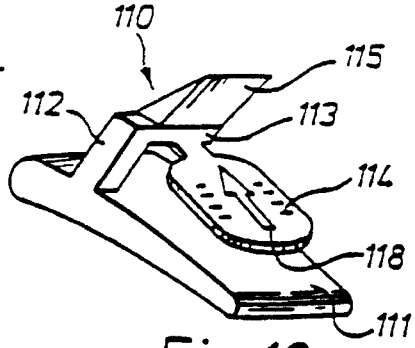
FIG. 12 is a perspective view of fourth embodiment of the device for attachment to a spool.
Figure 14:
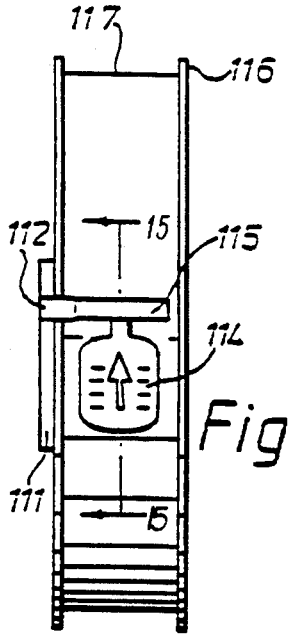
FIG. 14 is a plan view of the assembly of FIG. 13.

In use the device is placed over a reel 116 of ribbon 117 as illustrated in FIGS. 13 and 14; the dimensions of the device are determined by the reel dimensions, and the device may include one or more integral catches to loosely grip a flange of the spool. Such a catch may comprise a projection on the underside of arm 113, spaced from but facing towards upstanding leg 112.

Figure 15:
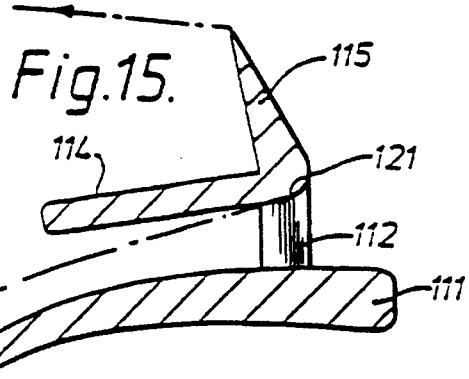
FIG. 15 is an enlarged transverse section through the device on line 15—15 of FIG. 14.

The device must be placed on the reel so that the arrow 118 on the thumb pad 114 faces in the same direction as the direction of ribbon winding. The consequent position of the ribbon in use is illustrated in FIGS. 13 and 15 by respective chain dot lines 119 and 120.

The forward lower edge 121 of arm 113 is smoothly curved, as shown, to avoid shearing stresses on the ribbon. The approach angle of the ribbon to the blade edge is determined by the relative position of the edge 121; the blade may be hollow ground to avoid the drag force exerted by the forward flank face thereof.

In use the ribbon spool is supported by the user loosely holding the device between thumb and forefinger. As the ribbon is drawn over the blade 115, the exit angle will determine the extend of shearing forces, if any, applied to the ribbon surface. The drag force on the ribbon, and hence the shearing effect of blade 115, can be increased by squeezing the base 111 and thumb grip 114 together, thus tending to prevent rotation of the spool.

Figure 16:
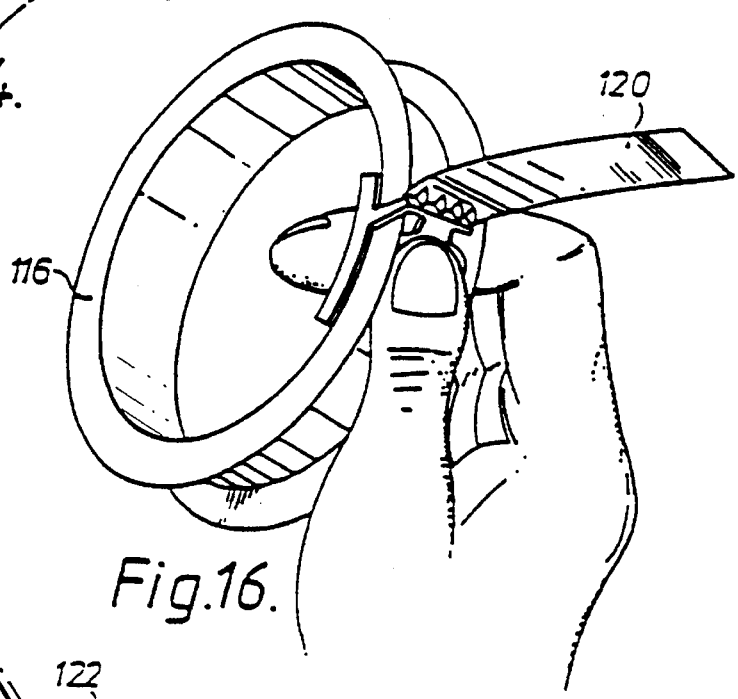
FIG. 16 illustrates the embodiment of FIG. 12 in use.
Figure 18:
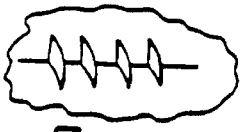
FIG. 18 is an enlarged illustration of the splitting hooks shown in FIG. 16.

FIGS. 16 and 18 illustrates splitting hooks on the upper side of the blade. The splitting hooks are aligned in the direction of ribbon movement in the manner of small knife blades, and the number may be chosen to suit the desired number of strands.

Figure 17:
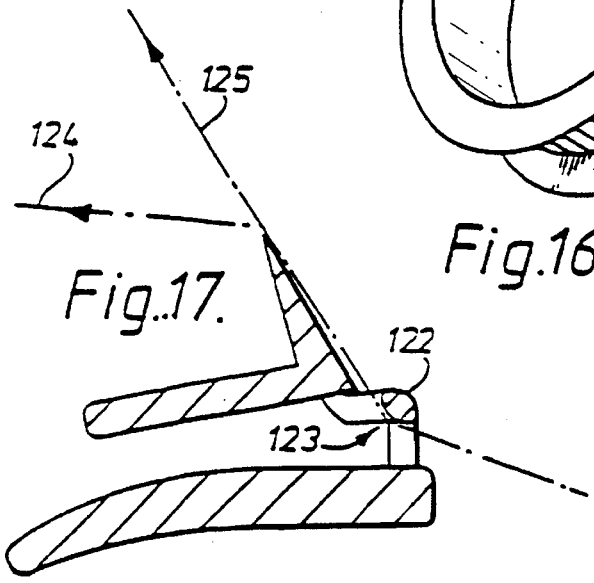
FIG. 17 is a transverse section through a fifth alternative embodiment and corresponding to FIG. 15.

FIG. 17 illustrates a transverse ribbon guide bar 122 which permits ribbon approach from the opposite direction to that shown in FIG. 15. The guide bar has a gently curving underside 123 to prevent undue stressing of the ribbon surface; the position of the ribbon when undergoing curling stress is indicated by chain-dot line 124. Ribbon drawn from the spool without curling is indicated by line 125.

The embodiment of FIG. 17 may be especially useful with ribbon having only one side suitable for curling, for example a ribbon with a metallic finish on one side only. Such ribbons are for presentation reasons always wound with the decorative side to the outside, and it is consequently necessary to curl the inner face as provided for in the FIG. 17 embodiment.

The device can include a protective shield for the blade which may extend arcuately over the blade edge; the shield may be moulded integrally with the device.

In the alternative the curling edge may be omitted so that device comprises splitting hooks only.

For the avoidance of doubt this invention is intended to encompass a spool within spool construction in which a loose spool of ribbon revolves freely within an outer spool shaped casing of which the device is part.

All of the drawings accompanying this application are illustrative and should not be scaled to establish particular mathematical relationships between the component parts. Many variations and changes are possible within the scope of the claims appended hereto.

I claim:

1. A ribbon curling device (13, 110) adapted to be used with a spool (11, 116) or reel of gift wrapping ribbon, said spool or reel being rotatable about an axis, the device being engageable with the spool such that the spool rotates in use relative to the device, and the device defining a ribbon exit pathway generally radially of the spool, ribbon guiding means (21, 121) disposed adjacent the pathway, and a ribbon curling edge disposed downstream of said ribbon guiding means, whereby a length of ribbon is curled on being drawn from said spool and against said ribbon curling edge, said ribbon guiding means ensuring a substantially constant approach angle of ribbon to said edge (19, 47, 115).

2. A device according to claim 1 and comprising a flexible split band (11) having substantially radially outwardly extending end portions (14, 15), a first of said end portions (14) having a radially outward curling edge (19) extending substantially parallel to the axis of rotation of said spool.

3. A device according to claim 2 wherein a second of said end portions (15) of the flexible split band has a foot at the inner end thereof, and said ribbon guiding means includes the foot.

4. A device according to claim 2 and further including abutment means (23) to space said end portions by a predetermined amount.

5. A device according to claim 4 wherein said abutment means comprises circumferentially extending legs (23) defining the ribbon exit pathway.

6. A device according to claim 2 and including latching means to disengageably engage said end portions.

7. A device according to claim 2 wherein said end portions (14, 15) are adapted to abut in use.

8. A device according to claim 2 wherein said band (11) is radially squeezable thereby to apply a retarding force to the ribbon on said spool.

9. A device according to claim 2 and further including ribbon splitting means comprising splitting blades (51) for Splitting said ribbon along a length thereof.

10. A device according to claim 9 wherein said splitting blades (51) are on said second of said end portions (15).

11. A device according to claim 10 wherein said blades (51) extend in a circumferential direction towards one of said end portions.

12. A device according to claim 11 wherein said blades (51) engage in apertures (54) of one of said end portions.

13. A device according to claim 2 comprising radially inwardly extending arms (31,32) at either side of said band, the inner ends of said arms being engageable in a central aperture of said spool.

14. A device according to claim 13 wherein said arms (31,32) have mutually facing projections (33) at respective radially inner ends thereof.

15. A device according to claim 14 wherein said projections (33) are disengageably engageable.

16. A device according to claim 13 wherein said arms (31,32) comprise at least one circumferentially aligned pair.

17. A device according to claim 16 wherein pairs of said arms (31,32) are provided at said end portions (14*a*, 15*a*).

18. A device according to claim 1 and comprising an arcuate inner member (111), a radially extending leg (112) on said inner member and a transverse outer member (113) extending substantially at right angles to a circumferential plane of said inner member, said device being engageable edgewise on said spool (116) and having a curling edge (115) on said transverse outer member.

19. A device according to claim 18 wherein said curling edge (115) extends substantially radially.

20. A device according to claim 18 further comprising a friction member (114) extending from said outer member (113) substantially in the same direction as said inner member (111) and being resiliently movable towards said inner member thereby to apply in use a retarding force to ribbon on said spool.

21. A device according to claim 18 wherein said ribbon guiding means comprises an edge of said outer member.

22. A device according to claim 21 wherein said ribbon guiding means comprises an aperture in said outer member.

23. A device according to claim 21 wherein said ribbon guiding means comprises an underside (121) of said outer member.

24. A device according to claim 18 further including splitting blades on said outer member.

25. A device according to claim 1, wherein the spool includes means to engage and retain said device for relative rotational movement.

26. A device according to claim 1 further comprising means for exerting a drag force on at least one of the ribbon or the spool.

27. A ribbon curling device (13, 110) adapted to be used with a spool (11, 116) or reel of gift wrapping ribbon, said spool or reel being rotatable about an axis, the device being engageable with the spool such that the spool rotates in use relative to the device, and the device defining a ribbon exit pathway generally radially of the spool, ribbon guiding means (21, 121) disposed adjacent the pathway, and a ribbon curling edge disposed downstream of said ribbon guiding means, whereby a length of ribbon is curled on being drawn from said spool and against said ribbon curling edge, said ribbon guiding means ensuring a substantially constant approach angle of ribbon to said edge (19, 47, 115), said spool having means to engage and retain said device for relative rotational movement, said spool also having mutually facing circumferential extending grooves (41) on inner flange faces having respective outer edges and adjacent the outer edges of said flanges, and said curling device comprising a first and second arcuate members (45, 46) engageable in said grooves (41) such that said spool is rotatable relative to said first and second members, and said first and second members are movable in said groove relative to one another, said first and second members having upstanding mutually adjacent first and second end portions defining the ribbon exit pathway, and the first of said end portions having a curling edge (47) thereon.

28. A device according to claim 27 wherein the second of said end portions (15) has a foot at the inner end thereof, and said ribbon guide means includes the foot.

29. A device according to claim 27 wherein said end portions are spaced by projection means extending from at least said first end portion toward said second end portion to space the end portions apart.

30. A device according to claim 27 wherein the second of said end portions includes ribbon splitting blades (51).

31. A device according to claim 30 wherein said blades (51) extend towards said one of said end potions and engage an aperture (54) thereof.

32. A device according to claim 27 further comprising means for exerting a drag force on at least one of the ribbon or the spool.

* * * * *